US006672467B2

(12) United States Patent
Merkel et al.

(10) Patent No.: US 6,672,467 B2
(45) **Date of Patent: *Jan. 6, 2004**

(54) ARTICULATING TRUSS BOOM

(76) Inventors: Joseph J. Merkel, W. 198 N. 11333 Jamestree Rd., Germantown, WI (US) 53022; Albert Jubeck, 890 Scenic Rd., Hubertus, WI (US) 53033-9522; H. Peter Huttelmaier, 4356 S. Regal Ct., New Berlin, WI (US) 53151-6737; Michael W. Wallschlaeger, 3238 S. Mayfield Rd., Jackson, WI (US) 53037-9790

( * ) Notice: Subject to any disclaimer, the term of this patent is extended or adjusted under 35 U.S.C. 154(b) by 13 days.

This patent is subject to a terminal disclaimer.

(21) Appl. No.: 09/945,028

(22) Filed: Aug. 31, 2001

(65) Prior Publication Data

US 2002/0056692 A1 May 16, 2002

Related U.S. Application Data

(63) Continuation-in-part of application No. 09/201,930, filed on Dec. 1, 1998.

(51) Int. Cl.[7] ..... B66C 23/64

(52) U.S. Cl. ..... 212/168; 414/723

(58) Field of Search ..... 212/168, 177, 212/179, 180, 199, 245, 293; 414/607, 723, 724, 744.1, 744.2, 744.3, 744.4, 744.5, 744.6, 744.7, 744.8, 688, 689, 690, 691, 692, 693, 694, 695.5–695.8, 686

(56) References Cited

U.S. PATENT DOCUMENTS

| | | | | | |
|---|---|---|---|---|---|
| 613,741 | A | * | 11/1898 | Vaughn | |
| 907,631 | A | * | 12/1908 | McGiffert | 212/293 |
| 2,990,074 | A | * | 6/1961 | Berquist et al. | 414/607 |
| 3,092,259 | A | * | 6/1963 | Swanson | 414/724 |
| 3,139,200 | A | * | 6/1964 | Burkhart | |
| 3,374,901 | A | * | 3/1968 | Ferwerda | 212/175 |
| 3,580,405 | A | * | 5/1971 | Siegel et al. | |
| 3,589,539 | A | * | 6/1971 | Witwer | |
| 3,807,108 | A | * | 4/1974 | Johnston | 52/115 |
| 3,836,025 | A | * | 9/1974 | Olson et al. | 214/77 R |
| 3,891,065 | A | * | 6/1975 | Iijima et al. | |
| 3,929,239 | A | * | 12/1975 | Shumaker | 214/138 R |
| 4,085,855 | A | * | 4/1978 | Worback | 91/420 |
| 4,159,059 | A | * | 6/1979 | Christenson et al. | 414/724 |
| 4,185,945 | A | * | 1/1980 | Gill | 414/694 |
| 4,221,531 | A | * | 9/1980 | Baron et al. | 414/694 |
| 4,243,148 | A | * | 1/1981 | Lampson | 212/196 |
| 4,349,307 | A | * | 9/1982 | Klem | 414/686 |
| 4,540,096 | A | * | 9/1985 | Orvis | 212/177 |
| 4,571,146 | A | * | 2/1986 | Eriksson | 414/687 |
| 4,741,663 | A | * | 5/1988 | Kennedy | 414/695.5 |
| 5,169,281 | A | * | 12/1992 | Boisture | 414/724 |
| 5,570,991 | A | * | 11/1996 | Swenson et al. | 414/685 |
| 5,639,119 | A | * | 6/1997 | Plate et al. | 280/754 |
| 5,850,704 | A | * | 12/1998 | Harinen | 414/723 |
| 5,901,750 | A | * | 5/1999 | Kozinski | 138/45 |
| 6,336,565 | B1 | * | 1/2002 | Merkel et al. | 212/168 |

* cited by examiner

*Primary Examiner*—Thomas J. Brahan
(74) *Attorney, Agent, or Firm*—Boyle Fredrickson Newholm Stein & Gratz S.C.

(57) ABSTRACT

An articulating truss boom for use with a lifting machine is described. The articulating truss boom assembly includes an articulating truss boom frame, a stationary support member attachable to a lifting machine, and an internal pivot assembly having a vertical pivot axis interposed between and providing the connection between the stationary support member and the articulating truss boom frame. The articulating truss boom frame is capable of pivoting with respect to the stationary support member about the vertical pivot axis in a horizontal plane transverse to the vertical pivot axis. The articulating truss boom assembly includes a hydraulic assembly which includes a metering valve having a removable restrictor inserted therein. The removable restrictor has a constricted channel therethrough to limit the hydraulic fluid channeled to the hydraulic assembly. Rubber shock absorbing pads may be attached to at least one of the stationary support member and the articulating truss boom frame to prevent direct contact therebetween and minimize vibrational swaying.

39 Claims, 14 Drawing Sheets

ARTICULATING TRUSS BOOM

CROSS-REFERENCE TO RELATED APPLICATION

This application is a continuation-in-part and claims the benefit of patent application, U.S. Ser. No. 09/201,930 filed Dec. 1, 1998 the entire contents of which are hereby incorporated by reference.

BACKGROUND OF THE INVENTION

The present invention relates generally to material handling attachments. In particular, the invention relates to an articulating truss boom that is securely attached to the end of a lifting machine. The articulating truss boom has an internal pivot joint that permits secure horizontal movement and usage of the articulating truss boom.

In the construction industry it is common to utilize attachments on material handling or other lofting machines in order to increase both the height and reach of the lifting machines. In addition, it is often necessary to refine the placement of such attachments as truss booms for carrying housing trusses. For example, after a material handling machine with an associated telescoping boom or other lifting machine has positioned a truss boom as close to its intended location as is practical in the vertical direction, it may be necessary to refine the orientation of the attachment in the horizontal direction. Previously, changing the horizontal orientation of the attachment involved moving the entire material handling or lifting machine and repositioning the entire apparatus for another attempt, which would not guarantee optimal orientation of the attachment. This procedure is time-consuming and potentially dangerous, moving the entire material handling machine may involve removing stabilizers and leveling equipment, backing up and repositioning the material handling machine with relatively heavy loads. Additionally, it may not always be possible to move the material handling machine closer to the desired location, as is the case when the machine would be parallel to a wall.

It would be advantageous to be able to place the truss boom into its final horizontal position by simply pivoting the truss boom while the truss boom was still securely attached to the telescoping boom or other implement of the material handling or lifting machine.

U.S. Pat. No. 4,159,059, issued to Christenson et al, discloses a truss boom for a material handling truck that is shown to horizontally move with the assistance of a fork assembly, tilt cylinder and the outer arm of an outer boom. The use of such a structure is dependent upon the availability of a fork lift or other fork assembly. Additionally, the fork assembly engages the truss boom and together they are pivoted by the tilt cylinder which is positioned between the fork assembly and the boom. The additional weight of the fork assembly on the load side of the pivot point significantly decreases the potential extension length and the load bearing capabilities of the truss boom, particularly at near limit extension lengths and loads for the particular machine. It would be advantageous, therefore, to have an articulating truss boom that increased the load bearing capabilities of the machine and that does not require the use of a particular type of machine.

Additionally, it is found that when a load in a truss boom, for example, is moved to the limit of its pivot arch in the horizontal direction, a contact is made between the pivot joint and the truss boom frame. This contact results in a relative motion of the entire machine due to the vibration of the contact, potentially a dangerous occurrence. It would therefore also be advantageous to provide some shock absorbing capability of the articulating truss boom to minimize the direct metal to metal contact which may cause undesirable vibrational swaying. Although the prior art discloses a truss boom that with assistance is capable of some horizontal movement with limited loads, it would be advantageous to have an articulating truss boom that solves the aforementioned problems not solved by the prior art.

SUMMARY OF THE INVENTION

The present invention provides an articulating truss boom that overcomes the aforementioned problems, and provides a truss boom that is capable of horizontally pivoting while carrying an appropriate load.

In accordance with one aspect of the invention, an articulating truss boom assembly for use with a lifting machine is provided and includes an articulating truss boom frame. The articulating truss boom assembly preferably comprises a stationary support member which is attachable to a lifting machine, and an internal pivot assembly. The internal pivot assembly has a vertical pivot axis and is interposed between and provides a connection between the stationary support member and the articulating truss boom frame. The articulating truss boom frame is capable of pivoting with respect to the stationary support member about the vertical pivot axis in a horizontal plane. The horizontal plane is transverse to the vertical pivot axis.

In accordance with another aspect of the invention, an articulating truss boom assembly for attachment to a lifting machine preferably includes a stationary support member. The stationary support member includes a coupling assembly for coupling the stationary support member to the lifting machine. The coupling assembly comprises a support beam and a pair of securing members extending therefrom. Each securing member includes a hook portion and a securing lobe having an aperture therein. The hook portions and the securing lobes are capable of locking engagement with the lifting machine. The securing members (e.g., the lobes and hook portions) are configured and dimensioned to fit nearly any make and model of lifting machine. The stationary support member further includes a first pair and a second pair of parallel stationary member support plates. Each pair of stationary member support plates has an aperture and includes a reinforcement plate or plates transversely connected therebetween.

The articulating truss boom assembly may further include an articulating truss boom frame having a first pair and a second pair of truss boom support plates. Each pair of parallel truss boom support plates has an aperture and includes a truss boom frame reinforcement plate or plates transversely connected therebetween. A pivot pin having a pivot sleeve is interposed between the stationary member and the articulating truss boom frame. An actuator member is connected to the pivot sleeve for pivoting the articulating truss boom frame in a horizontal pivot plane transverse to the pivot pin. The articulating truss boom assembly further includes a hydraulic assembly connected to the actuator to provide hydraulic fluid to the actuator and to facilitate pivoting of the articulating truss boom frame. The first and second pair of parallel stationary member support plates and the first and second pairs of parallel truss boom support plates are interlaced such that the parallel apertures of the stationary member support plates line up with the apertures of the parallel truss boom support plates. The support plates receive the pivot pin extending transversely therethrough.

In accordance with another aspect of the invention, the articulating truss boom assembly preferably has a hydraulic assembly connected to the pivot sleeve. The hydraulic assembly includes an actuator and a hydraulic power cylinder securely mounted at a first end to the stationary support member. The hydraulic power cylinder has a hydraulic fluid connector extending therefrom. The hydraulic assembly further includes a moveable plunger arm inserted into a second end of the hydraulic power cylinder to permit translational movement of the moveable plunger arm. An actuator lever is connectably attached to the movable plunger arm and has an aperture to receive the pivot pin therethrough. The actuator lever rotates with respect to the pivot pin and moves the articulating truss boom frame when the moveable plunger arm is in translational movement. A hydraulic control unit is connected to the stationary support member for supplying hydraulic fluid to the hydraulic power cylinder.

The hydraulic assembly may further include a metering valve connected to the fluid connector and operatively associated with the hydraulic power cylinder. The metering valve conducts hydraulic fluid from the hydraulic control unit to the hydraulic power cylinder. A restrictor is removably inserted within the metering valve. The restrictor has a restricted channel therethrough to limit the hydraulic fluid channeled to the hydraulic power cylinder. Preferably, a plurality of rubber shock absorbing pads is attached to prevent direct contact of the stationary member and the articulating truss boom frame.

Accordingly, one object of the present invention is to provide an articulating truss boom that pivots in a horizontal direction.

Another object of the present invention is to provide an articulating truss boom that pivots in a controlled manner.

Yet another object of the present invention is to provide an articulating truss boom that minimizes metal to metal contact and vibrational swaying.

Still another object of the invention is to have a relatively light boom that can lift as much as 4000 pounds with a 100% safety factor in a construction environment.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
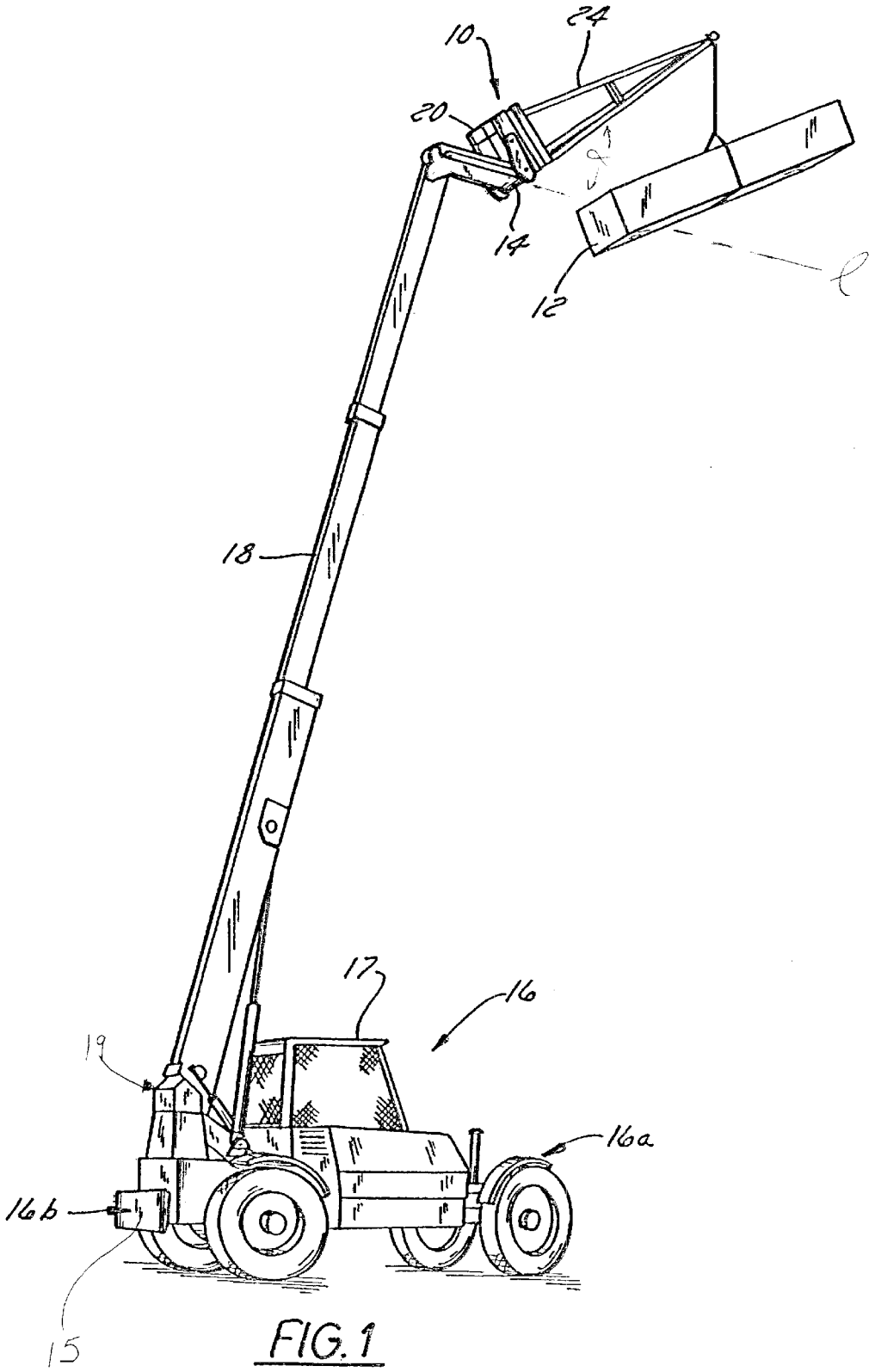
FIG. 1 is a perspective view of a lifting machine utilizing an articulating truss boom in accordance with the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE PREFERRED EMBODIMENTS

The present invention and the various features and advantageous details thereof are explained more fully with reference to the non-limiting embodiments described in detail in the following description.

Referring to in general to the drawings and more specifically to FIG. 1, an articulating truss boom assembly is shown and is designated generally by the numeral 10. The articulating truss boom assembly 10 is shown carrying a load 12 and is shown attached to the attachment coupler 14 of the lifting machine 16. The lifting machine 16 is shown utilizing a telescoping boom 18. The lifting machine 16 is of the conventional type and may include such machines as telescopic handlers, all-terrain fork lifts, or any other machine that may require increased height and/or reach of the implements attached thereto. The lifting device or handler 16 includes a front 16*a*, a rear 16*b* and cab 17. Preferably, the boom 18 diagonally extends over the cab 17 toward the front 16*a* of the handler 16 and rotates as a single arm 19 about a vertical axis.

A device for cleaning the lifting machine 16 preferably is an air compressor 15. The compressor 15 is used to blow dirt and dust off of the machine to keep it in good working order at the construction site. Other features may be present of the lift to make it more suitable for a new development site, such as a self-leveling hydraulic suspension for the front and rear, over-sized large tread tires, a pressurized cab to keep out dust, a wide wheel base, and extension balancing legs.

Figure 2:
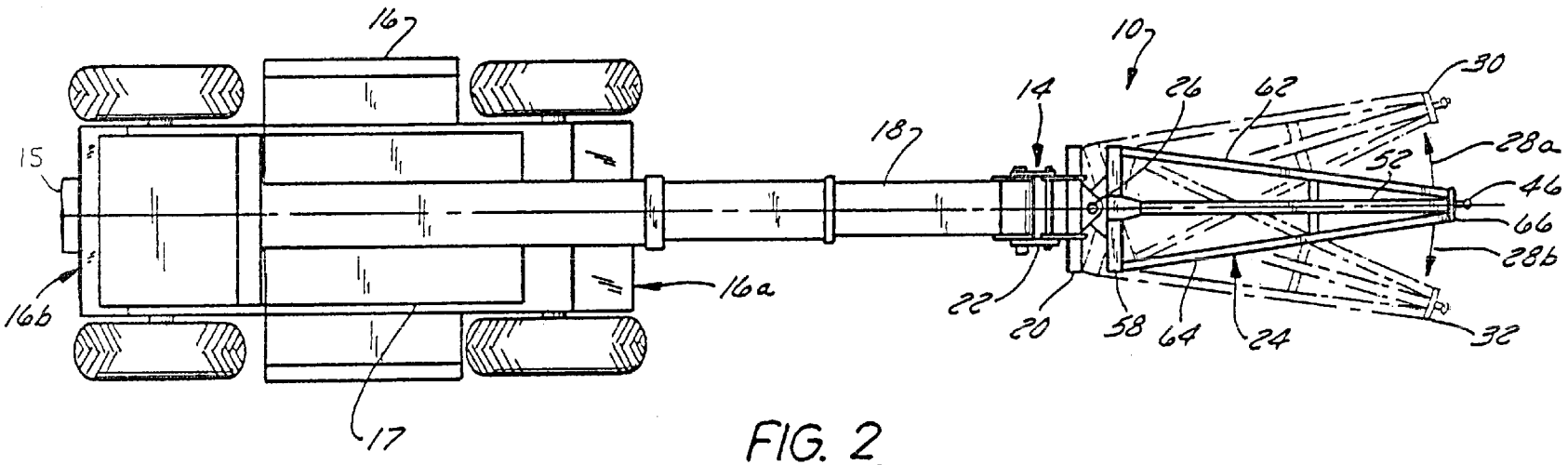
FIG. 2 is top plan view of the lifting machine showing the relative pivoting motion of the articulating truss boom in accordance with the present invention.

Referring now to FIG. 2, the articulating truss boom assembly 10 is shown in its central position. The articulating truss boom assembly 10 includes a support member 20 which is connected to telescoping boom coupler 22. The telescoping boom coupler 22 in a conventional manner is attached to the telescoping or telescopic boom 18 of the lifting machine 16.

The articulating truss boom assembly 10 also includes an articulating truss boom frame 24 which pivots about an internal pivot assembly 26 with respect to the support member 20. The articulating truss boom frame 24 is capable of pivoting in a plane parallel to the ground and transverse to the internal pivot assembly 26. In operation, the articulating truss boom frame 24 is capable of following a path indicated by pivot path arrow 28*a* until a full pivot is achieved at position 30 (shown in phantom). Correspondingly, the articulating truss boom frame 24 may also swing in the opposite direction along a path indicated by the pivot path arrow 28*b* until a second maximum pivot position is achieved as is indicated by position 32 (shown in phantom). However, it is contemplated by the present invention to include maximum swings which exceed the swing shown in the disclosed embodiment or may be shortened to increase stability of the lifting machine. Also, it is important to note that the movement shown is a relatively controlled movement even with large loads (e.g. 3500 pounds) being borne by the articulating truss boom assembly 10. The boom assembly 10 is also able to move the truss boom frame 24 upwardly in dependent of the boom's movement from a plane $\theta$ at an angle $\alpha$ as best shown in FIG. 1.

Figure 3:
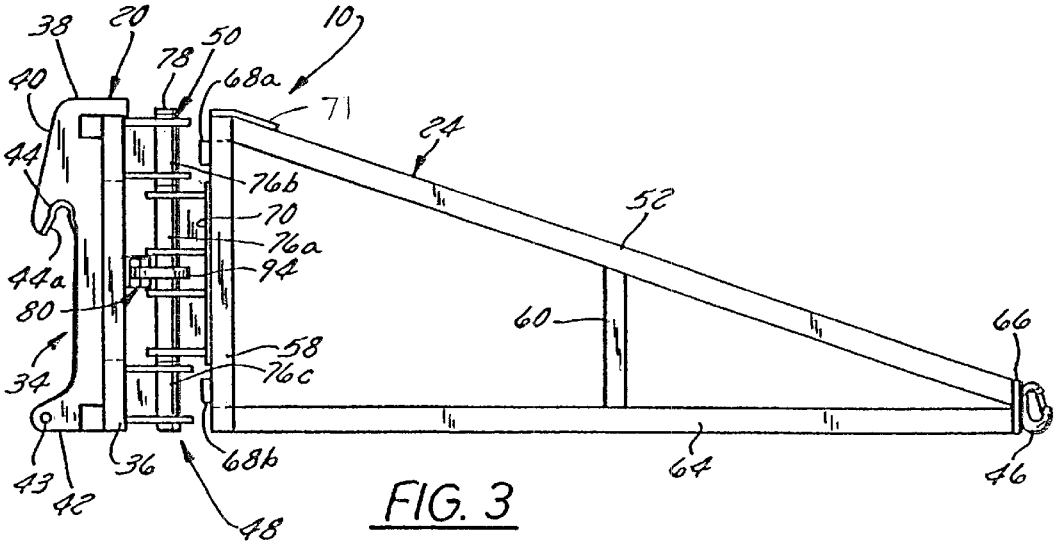
FIG. 3 is a side elevational view of an articulating truss boom in accordance with one aspect of the invention.

Referring now to FIG. 3, a detached articulating truss boom assembly 10 is shown, and includes the stationary support member 20. The stationary support member 20 includes a coupling assembly 34. The coupling assembly 34 includes a support beam 36 and a pair of securing members 38 extending transversely therefrom. Each securing member 38 includes a hook portion 40 and a securing lobe 42. The hook portion 40 has a contour catch 44 with a mouth 44*a* having a larger outer diameter. The securing lobe 42 includes an aperture 43 through which a retaining pin (not shown) may be inserted. The hook portion 40 and the securing lobe 42 are dimensioned to permit ready connection and disconnection from the lifting machine, and is also known as a quick connect feature. These features are sized to preferably permit the articulating truss boom assembly 10 to be attached to TH63 Telescopic Handler lifting machines made by Caterpillar, Inc. of Peoria, Ill. However, one skilled in the art would realize that with modifications the coupling members can be adapted to fit nearly any make and model of lifting machine. Preferably, there is only 1/16 inch play (maximum) between the inside dimension of the lifting machine quick disconnect member and the outside dimension of the rear of support member. In order to ensure minimum and play and thus maximize boom safety, shims may be connected (e.g., welded) to the frame or the machine. The articulating truss boom frame 24 further includes a load carrying member 46 preferably an industrial one-way latch, for securely carrying the load 12 to be moved by the articulating truss boom assembly 10.

Interposed between the stationary support member 20 and the articulating truss boom frame 24 is an internal pivot assembly, shown generally at 48. The internal pivot assembly 48 has a vertical pivot axis and provides the connection between the stationary support member 20 and the articulating truss boom frame 24. The vertical pivot axis is coaxial with pivot sleeve 50. In this way, the articulating truss boom frame 24 is capable of pivoting with respect to the stationary support member 20 about the vertical pivot axis in a horizontal plane transverse to the vertical pivot axis.

Figure 4:
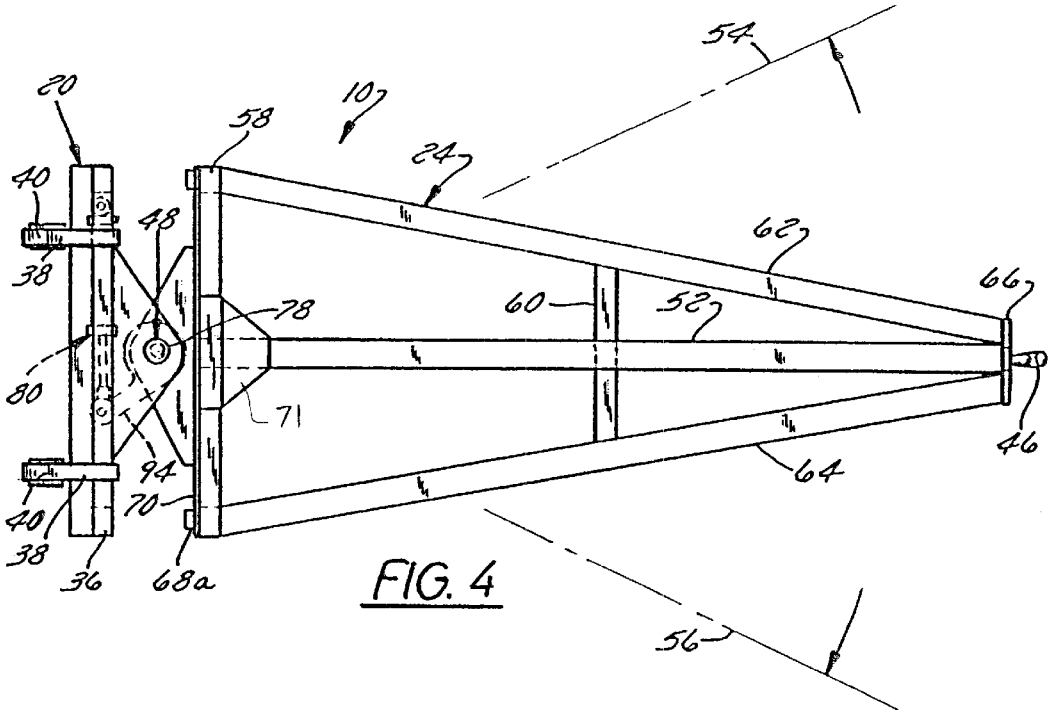
FIG. 4 is a top plan view of FIG. 3 showing the pivoting of the articulating truss boom frame in accordance with one aspect of the invention.

Referring now to FIG. 4, the preferred horizontal swing of the center beam 52 of the articulating truss boom frame 24 is shown. In operation, the articulating truss boom frame 24 can pivot such that the center beam 52 lies in a path coinciding with dashed line 54, which represents a left pivoting limit. In doing so, the load carrying member 46 preferably strikes an arc of approximately 5.25 feet. Similarly, the articulating truss boom frame 24 is also capable of pivoting in the horizontal plane such that the center beam 52 rests in a path coinciding with dashed line 56, which represents a right pivoting limit. Again, in doing so, the load carrying member 46 strikes an arc from center to line 56 of approximately 5.25 feet. In total, then, the articulating truss boom frame 24, in the preferred embodiment shown, is capable of a swing of approximately 10.5 feet. However, arc swings greater than 10.5 feet are contemplated by the present invention. Nonetheless, the greater the swing arc, the more unstable the boom becomes when carrying a load. Thus, it is important to consult the manufacturer's posted tolerances before lifting.

Figure 5:
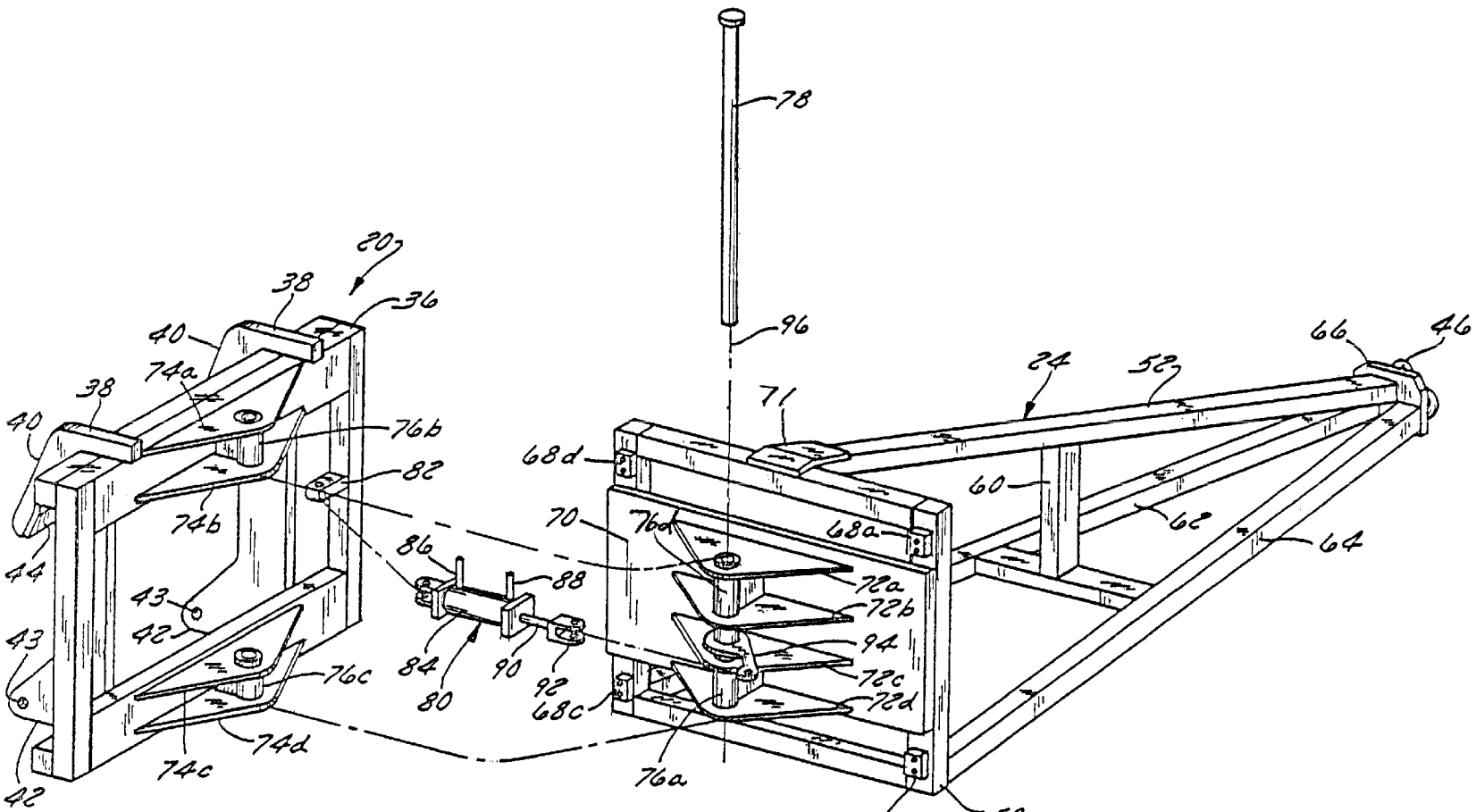
FIG. 5 is a partially exploded view of the articulating truss boom showing the pivot assembly in accordance with one aspect of the invention.

Referring now to FIG. 5, the articulating truss boom frame 24 includes a back portion 58 from which the center beam 52 and two base beams 62, 64 extend and converge and are connected to a front plate 66, to which the load carrying member 46 is attached. A T-support section 60 braces and provides additional strength to the center beam 52 and the base beams 62 and 64. While T-support bracing is easier to manufacture, other forms of bracing, such as, a triangular configuration (discussed below) may be stronger. Front plate or bracket 66 provides an additional strengthening connection between the center beam 52 and the back portion 58. The back portion 58 of the boom frame 24 preferably includes a plurality of shock absorbing pads 68*a*–68*d*, which are used to absorb the shock that occurs when the articulating truss boom frame 24, during its pivoting action, makes contact with the stationary support member 20. Although four shock absorbing pads are shown, it is understood that a different number of shock absorbing pads could be used, and that the shock absorbing pads 68*a*–68*d* could also be placed on the corresponding area of the support member 20 to achieve the same result. The shock absorbing pads 68*a*–68*d* are preferably made of a rubber material, and they minimize the vibrational swing that occurs when the articulating truss boom frame 24 contacts the stationary support member 20, particularly at full pivoting limits. Also attached between the ends of the back portion 58 is support plate 70.

Extending horizontally from the support plate 70 are a first pair of truss boom frame support plates 72*a*, 72*b* and a second pair of truss boom frame support plates 72*c*, 72*d*. The truss boom frame support plates 72*a*–72*d* are preferably constructed of a high strength material, such as steel, and are welded or otherwise securely attached to the support plate 70.

The support member 20 includes a first pair of support member support plates 74*a*, 74*b* and a second pair of support member support plates 74*c*, 74*d*. Both pairs extend horizontally from member 20.

Each of the support plates 72*a*–*d* and 74*a*–*d*, includes an opening to receive a pivot sleeve 76*a*–76*c* therethrough. In operation, pivot sleeve 76*a* is grease-fitted on either side to receive pivot sleeves 76*b* and 76*c* in order to permit the rotation of pivot sleeve 76*a* with respect to pivot sleeves 76*b* and 76*c*. A pivot pin 78 is then inserted through the pivot sleeves 76*a*–76*c* to secure the articulating truss boom frame 24 to the support member 20. All three pivot sleeves are preferably grease-fitted to decrease friction and wear.

Figure 6:
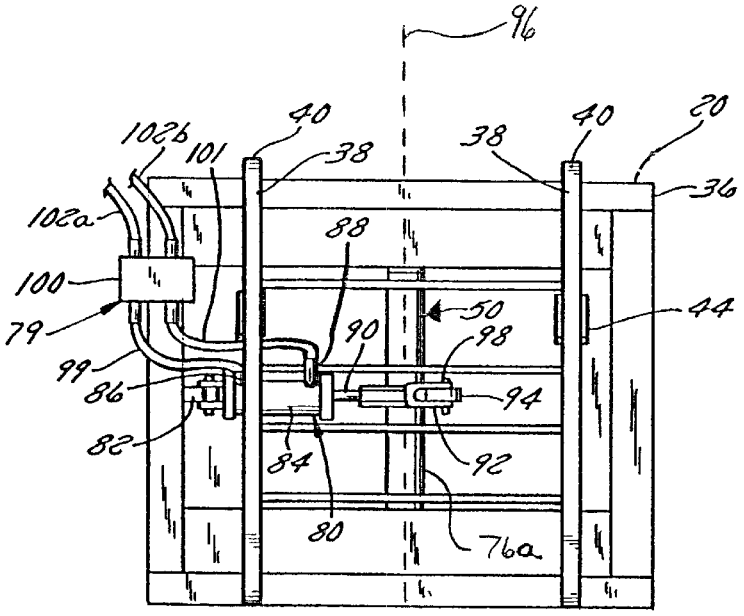
FIG. 6 is a front view of the articulating truss boom assembly showing the location of the actuator in accordance with one aspect of the invention.

A hydraulic assembly 79, as best shown in FIG. 6 includes an actuator 80 which is attached to the stationary support member 20 via an extending tab member 82. Tab member 82 preferably is grease-fitted. The actuator 80 includes a hydraulic power cylinder 84 into which the hydraulic fluid is pumped by hydraulic lines (not shown) into metering valve 86 and returning hydraulic fluid is discharged via hydraulic outlet 88. Extending from the hydraulic power cylinder 84 is a movable plunger arm 90 that responds to hydraulic fluid pressure within the hydraulic power cylinder 84. A movable plunger arm 90 is attached with linkage 92 to an actuator lever 94. The actuator lever 94 is rigidly secured about the pivot sleeve 76*a* such that movement of the actuator lever 94 results in rotation of the pivot sleeve 76*a*, and therefore the articulating truss boom frame 24 (not shown). Preferably, actuator lever 94 has a grease fitting as well (not shown).

When it is desired to horizontally pivot the articulating truss boom frame 24, hydraulic fluid is injected into the hydraulic power cylinder 84. The hydraulic power cylinder 84 forces the movable plunger arm 90 to rotate the actuator lever 94, resulting in pivoting action about the pivot axis represented by dashed line 96. Similarly, to effectuate pivoting in the opposite direction, hydraulic fluid is withdrawn from the hydraulic power cylinder 84, resulting in a compression of the movable plunger arm 90 with subsequent movement of the actuator lever 94 and pivot sleeve 76*a*.

Continuing with FIG. 6, the hydraulic power cylinder 84 is shown connected to the moveable plunger arm 90. The moveable plunger arm 90 is held to the actuator lever 94 by a securing pin 98. Preferably, the securing pin 98 is 0.001 to 0.003 of an inch smaller than the receiving hole to prevent unnecessary twisting of the boom when shifting a load. The hydraulic power cylinder 84 receives hydraulic fluid through the metering valve 86. The metering valve 86 is connected to a fluid connector 99 which conducts hydraulic fluid from a hydraulic control unit 100 to the metering valve 86. The hydraulic control unit 100 also receives a return fluid connector 101 which receives hydraulic fluid from the hydraulic outlet 88. The hydraulic control unit 100 is in communication with a hydraulic fluid supply (not shown) via hydraulic lines 102*a* and 102*b*. It is recognized that hydraulic control unit 100 may take various forms depending on the particular manufacturer's specifications and requirements or the particular manufacturer's internal hydraulic system that the boom is attached to.

Figure 7:
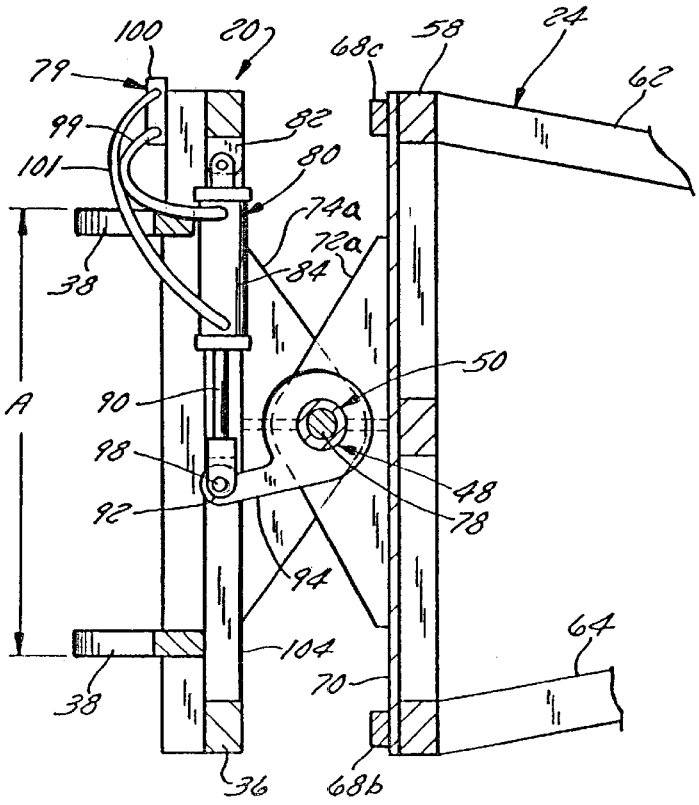
FIG. 7 is a partial top sectional view showing the pivot assembly in accordance with one aspect of the invention.

Referring now to FIG. 7, the truss boom frame support plate 72*a* is shown interlaced with the stationary member support plate 74*a*. Each of the support plates preferably has a generally triangular shape, although any suitable shape is contemplated by the present invention. The benefit of the substantially triangular shape is that the articulating truss boom frame 24 is not stopped from pivoting by the premature contact resulting from the truss boom frame support plates 72*a*–*d* (*b*–*d* not shown) striking the surface 104 of the support member 20, causing undesirable metal to metal contact. It is important to note that the distance between the securing members 38 of the support member 20, as indicated by A, is specifically selected to engage a lifting machine incorporating a standardized connection system, termed alternatively a quick disconnect system. In the particular embodiment shown, the distance A is approximately 24.125 inches, although any distance between the securing members 38 is acceptable as long as the support member 20 can be attached to a lifting machine. Again, preferably, there is a 1/16 inch tolerance between coupling members 20 and 14 (not shown).

Figure 8:
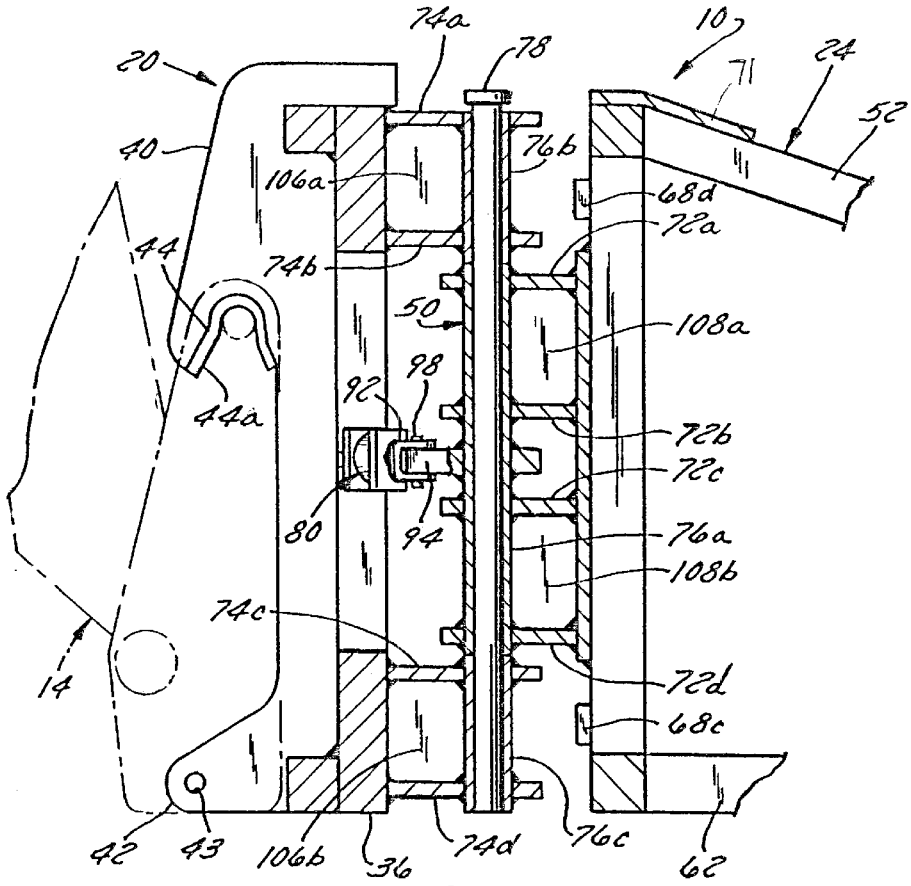
FIG. 8 is a partial side sectional view of the articulating truss boom assembly in accordance with one aspect of the invention.

Referring now to FIG. 8, the attachment coupler 14 (shown in phantom) is shown attached to the support member 20. In order to provide additional structural support in addition to the pivot pin 78, each pair of member support plates 74*a*–*d* includes a member reinforcement plate 106*a* and 106*b*. Similarly, each pair of truss boom frame support plates 72*a*–*d* has a frame reinforcement plate 108*a* and 108*b* transversely connected therebetween. Preferably, member reinforcement plates 106*a* and 106*b* and frame reinforcement plates 108*a* and 108*b* are ½ inch steel with a solid I-beam construction. The plates provide additional lifting strength and allow the articulating truss boom frame assembly 10 to pivot with additional support without unnecessary weight.

Figure 9:
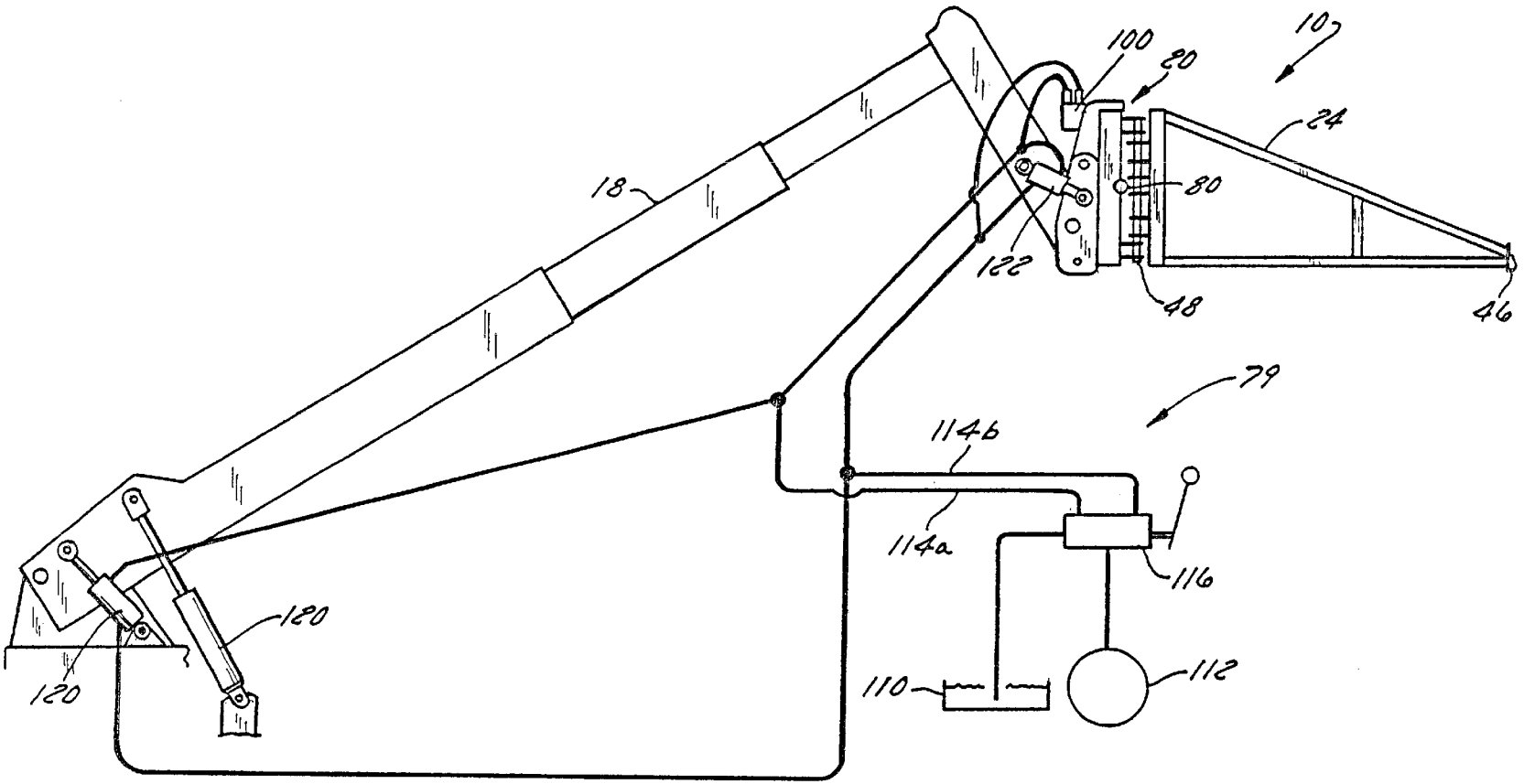
FIG. 9 is a schematic representation of the hydraulic system of the lifting machine utilizing the articulating truss boom in accordance with the invention.

Referring now to FIG. 9, a basic schematic of the hydraulic system is shown. From a hydraulic reservoir 110 hydraulic fluid is pumped via hydraulic pump 112 through hydraulic lines 114*a* and 114*b*. The flow of the hydraulic fluid is operated via control panel 116. The hydraulic fluid is directed towards hydraulic cylinders 120*a* and *b* and 122 associated with the telescoping boom 18. Hydraulic fluid is also directed towards the hydraulic control unit 100.

Figure 10:
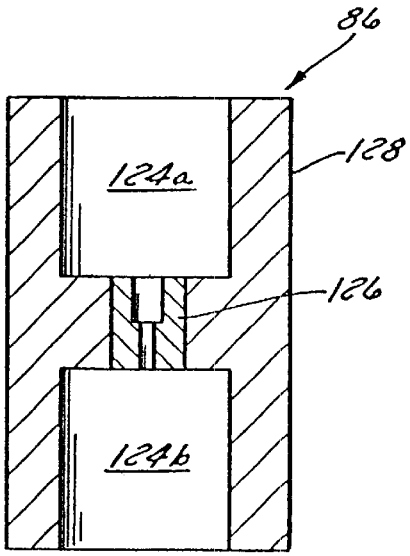
FIG. 10 is a side sectional view of the metering valve in accordance with one aspect of the invention.

Referring now to FIG. 10, a detailed look at the metering valve 86 is shown. The metering valve 86 limits the amount of hydraulic fluid entering the hydraulic power cylinder 84 (not shown). The metering valve 86 includes a pair of metering valve bores 124*a* and 124*b* extending partially therethrough. The size of the metering valve bores 124*a* and 124*b* is selected to properly engage the hydraulic connectors associated with the hydraulic lines and the hydraulic power cylinder 84 so as to provide a connection therebetween. The bores preferably vary in diameter. A restrictor 126 is removably inserted between the metering valve bores 124*a* and 124*b*. The restrictor insert 126 further limits the amount of hydraulic fluid flowing from metering valve bore 124*a* to metering valve bore 124*b*. The restrictor may be made of brass. Proper configuration of the hydraulic system is important as the hydraulic system controls the movement and the swing speed of the boom. For example, if the movement is not smooth or is too fast, a dangerous situation may be created when the boom is elevated with a load and the lift may topple.

Figure 11:
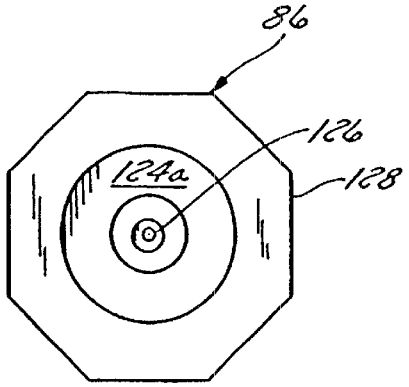
FIG. 11 is a top plan view of FIG. 10 showing the metering valve in accordance with one aspect of the invention.

Referring to FIG. 11, the metering valve 86 has an outer or outside wall 128 which define the boundaries of the metering valve bore 124*a* which terminates in the restrictor 126. The shape of the metering valve 86 outer wall 128 is preferably octagonal-shaped, to receive a standard wrench 131 for ease of removal. Nevertheless, any suitable shape is contemplated by the present invention.

Figure 12:
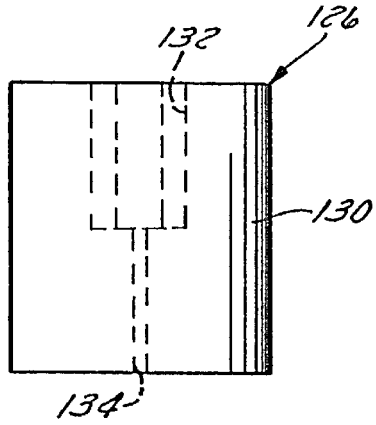
FIG. 12 is a side elevational view of the hydraulic restrictor in accordance with one aspect of the invention.

Referring now to FIG. 12, an enlarged view of the restrictor 126 is shown, and includes a restrictor body 130 which includes a first restricting channel 132 and second restricting channel 134, both shown in phantom. The second restricting channel 134 is smaller in diameter than the first restricting channel 132.

Figure 13:
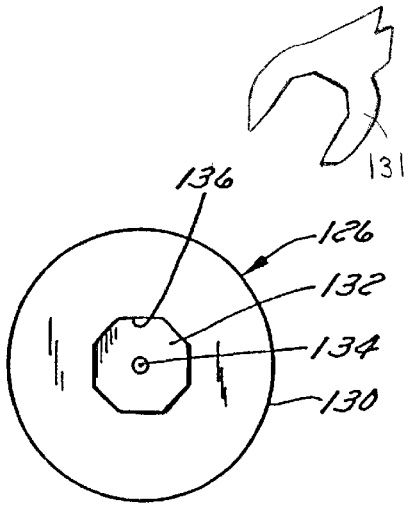
FIG. 13 is a top plan view of FIG. 12 showing the hydraulic restrictor in accordance with one aspect of the invention.
Figure 15C:
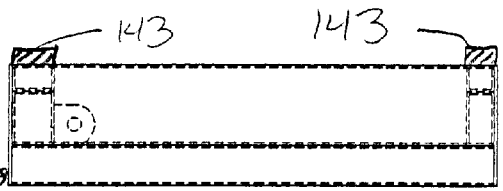
FIG. 15*c* is a top sectional view of the stationary support member of FIG. 15*a;*
Figure 15B:
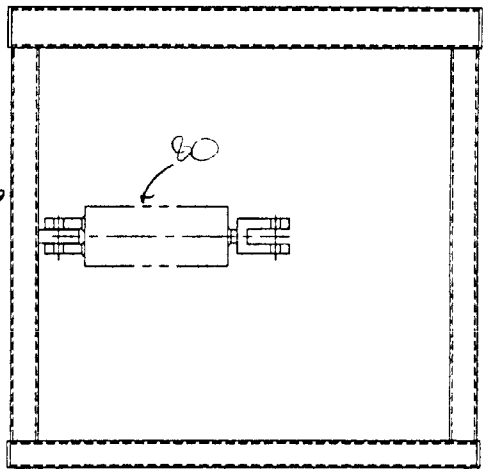
FIG. 15*b* is a front sectional view of the stationary support member of FIG. 15*a;*
Figure 15A:
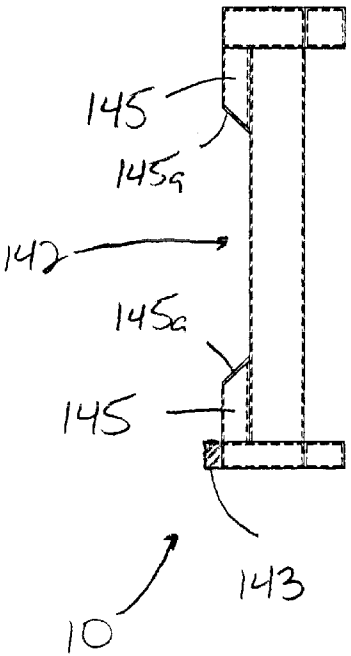
FIG. 15*a* is a side sectional view of a stationary support member of still another embodiment of the articulating truss boom assembly in accordance with the invention.

Referring to FIG. 13, the restrictor 126 has a generally circular shape with the first restricting channel 132 having a preferably octagonal outside wall 136. In the embodiment shown, the second restricting channel 134 has a preferred diameter of between 0.020 and 0.035 inches. It is the diameter of the second restricting channel 134 that determines the amount of hydraulic fluid into the hydraulic power cylinder 84 (not shown), and therefore the speed of the articulating truss boom assembly 10 (not shown). By creating a series of restrictors 126 having second restricting channels 134 of different diameters, and simply removing the restrictor 126 and replacing it with a restrictor of a different diameter, different pivoting speeds may be obtained. For example, a big opening creates faster movement and a smaller hole creates slower movement.

Figure 14:
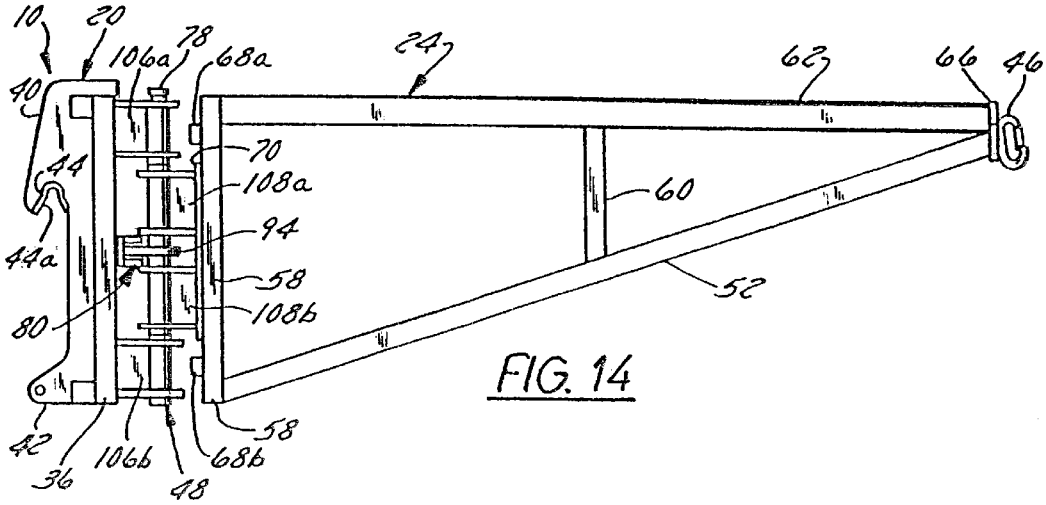
FIG. 14 is a side elevational view of another embodiment of the articulating truss boom assembly in accordance with the invention.

Referring now to FIG. 14, another embodiment of the articulating truss boom assembly 10 is shown. In this embodiment, the articulating truss boom frame 24 is inverted such that the center beam 52 extends upward from the bottom of the back portion 58 to intersect with the base beam 62 at the load carrying member 46. The load carrying member 46 is of standard construction, as can be obtained from McMaster Carr, number 34685 T31 Weld-on Hook, which is acceptable. The inversion of the articulating truss boom frame 24 extends the height of the load carrying member 46 by the height of the back portion 58, which is preferably approximately 34 inches. The inverted truss boom frame also allows for horizontal extension of the truss boom assembly 10 with respect to the lifting machine 16.

Looking now at FIGS. 15–20, still another embodiment of the articulating truss boom assembly 10 is shown. In this embodiment, assembly 10 includes a stationary support member 142 and a truss boom frame 144. As best shown in FIGS. 15*a*–15*c*, the stationary support member 142 is formed similarly to the support member 20 disclosed in the previous embodiments and includes a pair of resilient pads 143 disposed on each side of the lower end of the support member 142. The support member 142 also includes a number of reinforcing members 145 that are attached to the support member 142 adjacent the upper and lower ends of the support member 142. Each reinforcing member 145 is preferably a separate section of steel tubing affixed to the support member 20 in between the hook portion 40 and securing lobe 42 located on each side of the support member 142. The reinforcing members 145 provide additional rigidity to the support member 142 such that the support member 142 is less easily deflected when a load is supported by the boom assembly 10. Each reinforcing member 145 includes a sloped upper end 145*a* that assists in guiding the attachment coupler 14 into engagement with the coupling assembly 34.

Opposite the reinforcing members 145, an internal pivot assembly 146 is disposed between the support member 142 and the truss boom frame 144. The assembly 146 includes a pivot channel 148, formed partially on the support member 142 and partially on the truss boom frame 144, in which the pivot pin 78 is retained to pivotally secure the truss boom frame 144 to the stationary support member 142.

The truss boom frame 144, as best shown in FIGS. 17*a*–17*d*, includes a support end 150 disposed adjacent the stationary support member 142. The support end 150 is formed of a top beam 152, a bottom beam 154 and a pair of side beams 156 connecting the top and bottom beams. The top beam 152 is shorter than the bottom beam 154, giving the support end 150 a trapezoidal appearance. The support end 150 also includes a vertical center beam 153 that provides enhanced strength to the support end 150. The boom frame 144 also includes an upper frame member 158 connected to and extending outwardly and downwardly from the top beam 152, and a pair of lower frame members 160 connected to and extending outwardly and inwardly from opposite sides of the bottom beam 154. The upper frame member 158 is also connected to the top beam 152 by a gusset plate 161. Opposite the support end 150, the upper frame member 158 and lower frame members 160 are joined to one another to form a load-carrying end 163 opposite the support end. The lower frame members 160 are also connected to the upper frame member 158 by a number of pairs of side frame members 162*a* and 162*b* (162*c* and 162*d* are opposite and parallel but are not shown). These frame members vary in length and are positioned along the length of the boom frame 144 in a triangular configuration. The lower frame members 160 are also rigidly positioned with respect to one another by a number of struts 164 of varying lengths extending between the lower frame members 160 along the length of the boom frame 144. Furthermore, the number of side frame members 162*a* and *c* and struts 164 can vary as needed to accommodate the length of a particular boom frame 144. For example, in FIGS. 17*a*–17*b*, the boom frame 144 has two opposed pairs of side frame members 162*a*–*d* and two struts 164. Alternatively, in FIG. 20 the boom frame 144 has only one pair of opposed side frame members 162*a* and 162*c* and one strut 164.

The load-carrying end 163 also includes a load-carrying plate 166 affixed to the ends of the upper frame member 158 and lower frame members 160 opposite the support end 150. The load carrying plate 166, best shown in FIG. 17*d*, supports a load carrying member 46 as disclosed in the previous embodiments.

Figures 16A, 16B, 16C:
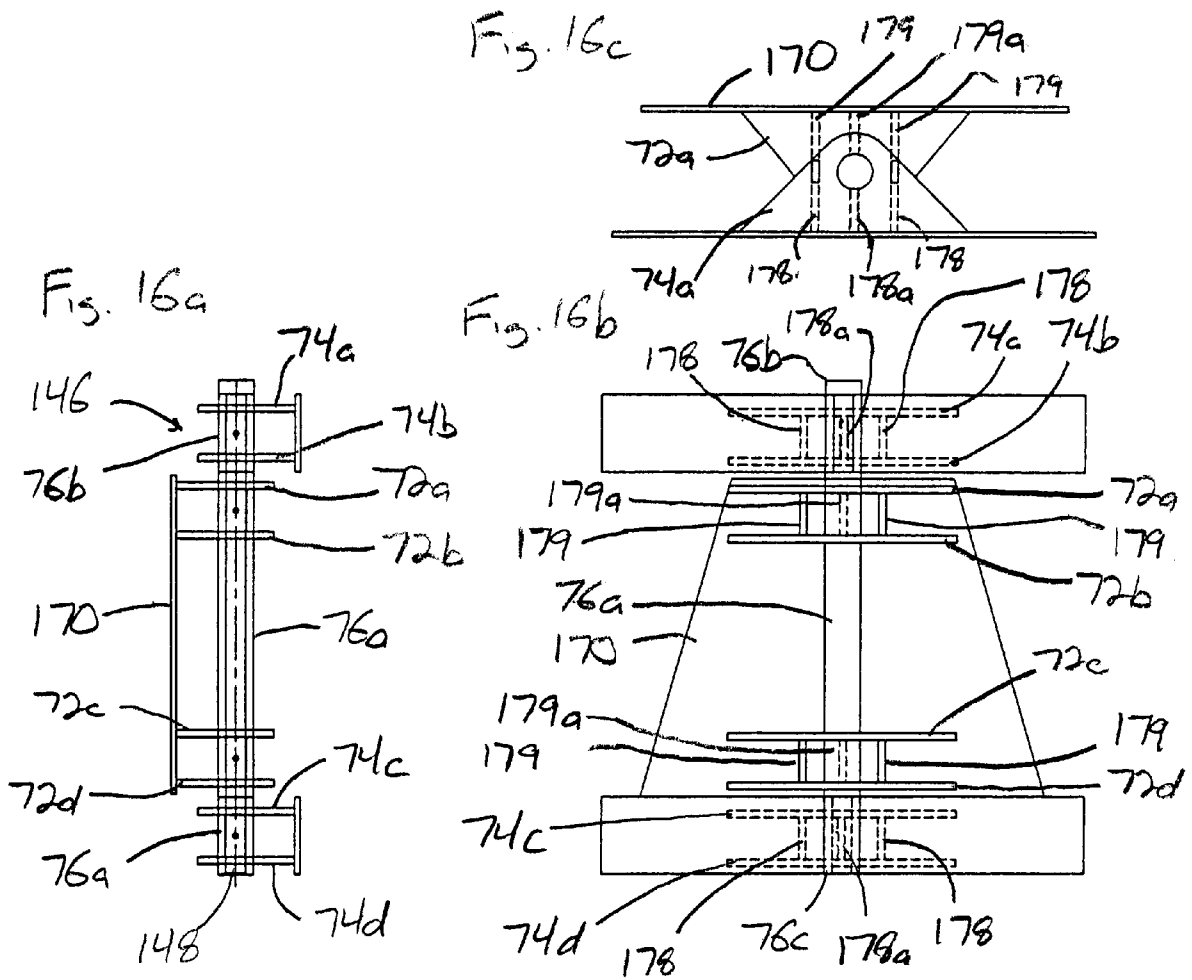
FIG. 16*a* is a side sectional view of an internal pivoting assembly of the embodiment of FIG. 15*a;*
FIG. 16*b* is a front sectional view of the pivoting assembly of FIG. 16*a;*
FIG. 16*c* is a top sectional view of the pivoting assembly of FIG. 16*a;*
Figure 17A:
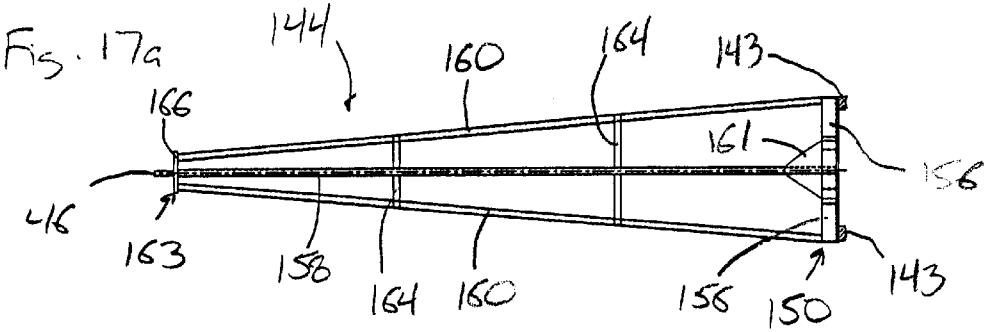
FIG. 17*a* is a top plan view of the truss boom frame of the embodiment of the articulating truss boom assembly of FIG. 15*a;*
Figure 17B:
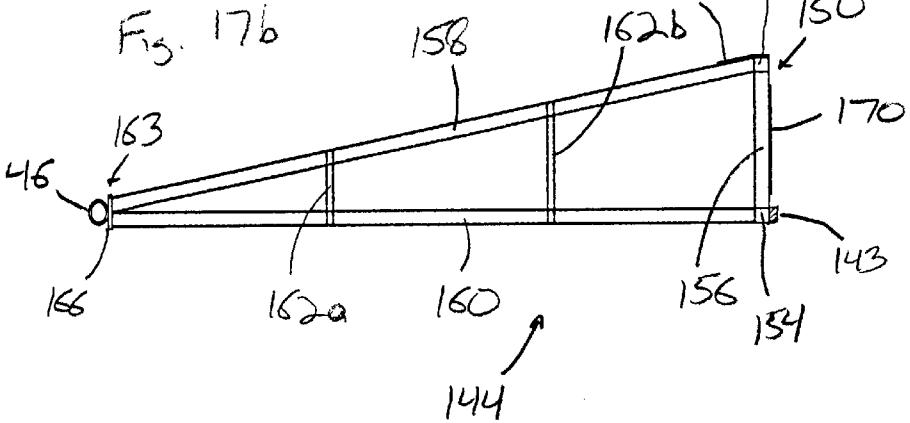
FIG. 17*b* is a side plan view of the truss boom frame of FIG. 17*a;*
Figure 17C:
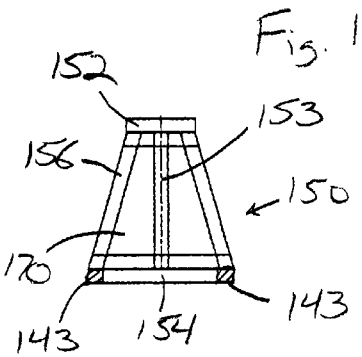
FIG. 17*c* is an end plan view of the truss boom frame of FIG. 17*a;*
Figure 17D:
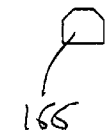
FIG. 17*d* is a front plan view of a load carrying plate attached to one end of the truss boom frame of FIG. 17*a;*
Figure 18D:
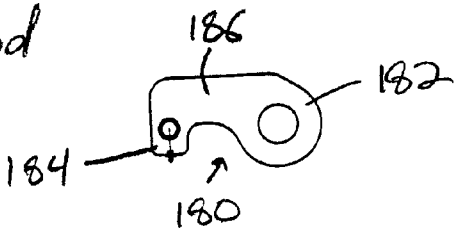
FIG. 18*d* is a top plan view of an actuator lever attached to the pivoting assembly of FIG. 15*a;*
Figure 18C:
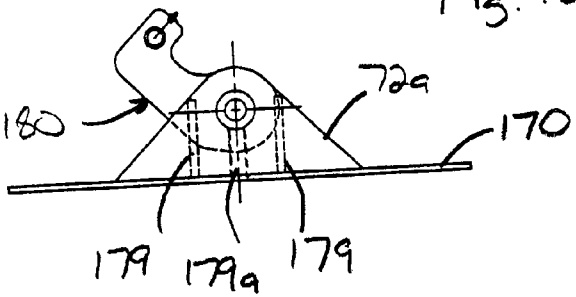
FIG. 18*c* is a top sectional view of the pivoting assembly of FIG. 18*a;*
Figure 18B:
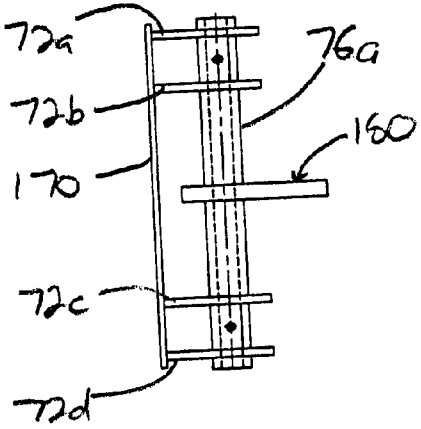
FIG. 18*b* is a side sectional view of the pivoting assembly of FIG. 18*a;*
Figure 18A:
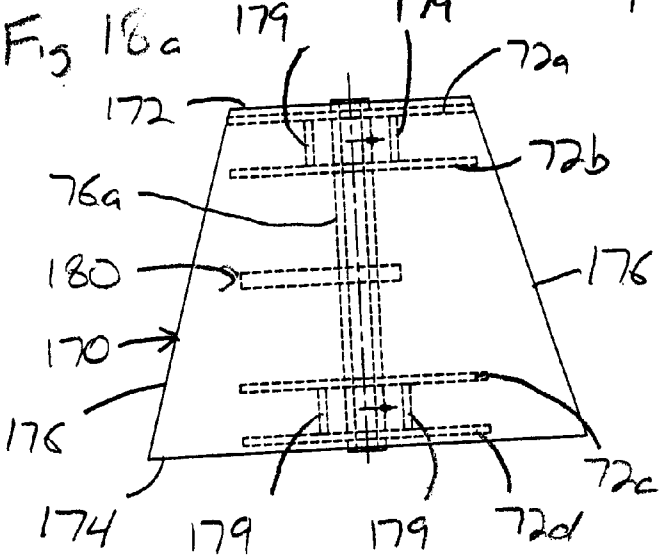
FIG. 18*a* is a front sectional view of the internal pivoting assembly of FIG. 16*a;*

Opposite the respective frame members, the support end 150 includes a support plate 170. The plate 170 includes a top end 172, a bottom end 174, and a pair of sides 176 joining the top end 172 and bottom end 174. Similar to the arrangement of the support end 150, the top end 172 of the support plate 170 is shorter than the bottom end 174, such that the support plate 170 has a generally trapezoidal configuration. The support plate 170 also has a pair of resilient pads 143 disposed on opposite sides of the bottom end 174 that engage the corresponding pads 143 disposed on the support member 142 to prevent damage from being done to the plate 170 and boom 144 by contact with the support member 142. Similar to the previous embodiments, as shown in FIGS. 18*a*–18*b*, the support plate 170 is attached to a number of truss boom frame support plates 72*a*–*d* which are disposed in opposed pairs located adjacent the top end 172 and bottom end 174 of the support plate 170, respectively. Each pair of plates 72*a*–*b* and 72*c*–*d* is held in position by a pair of braces 179 which extend generally perpendicularly between the respective plates, and optionally by a secondary brace 179*a*, as shown in FIGS. 16*b*–16*c* and FIG. 18*c*. The pairs of braces 179 are disposed on opposite sides of a first pivot sleeve 76*b* which extends through each of the plates 72*a*–*d* and forms a central portion of the pivot channel 148. The secondary brace 179*a*, if present, extends from the support plate 170 and directly contacts the first pivot sleeve 76*b*.

Figure 19A:
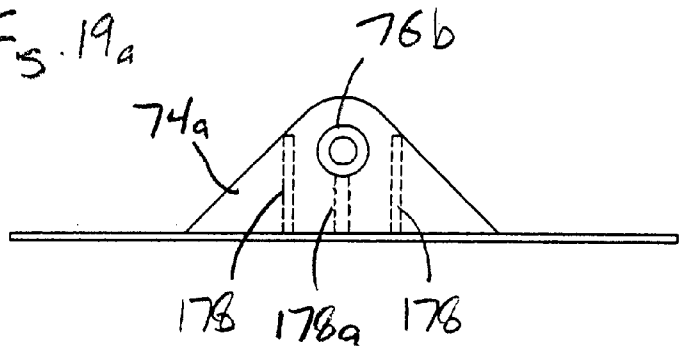
FIG. 19*a* is a top sectional view of a hinge assembly used in the pivoting assembly of FIG. 18*a;*
Figure 19B:
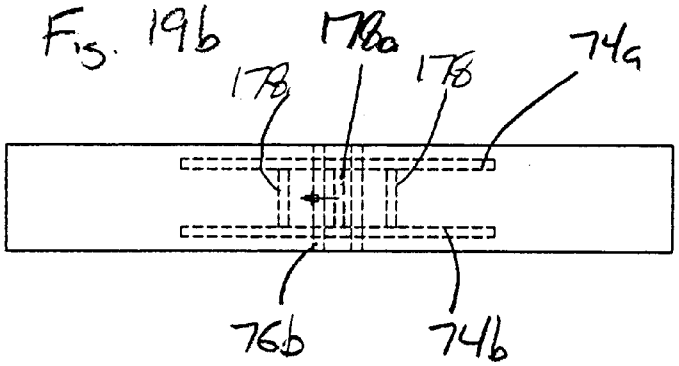
FIG. 19*b* is a rear sectional view of the hinge assembly of FIG. 19*a;*
Figure 19C:
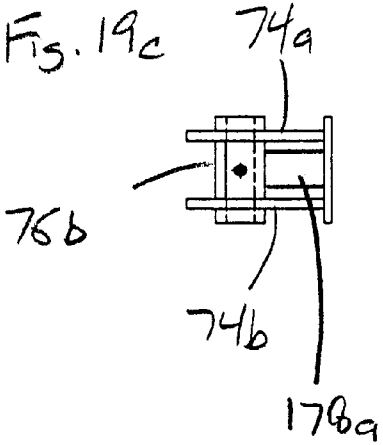
FIG. 19*c* is a side sectional view of the hinge assembly of FIG. 19*a*.
Figure 20:
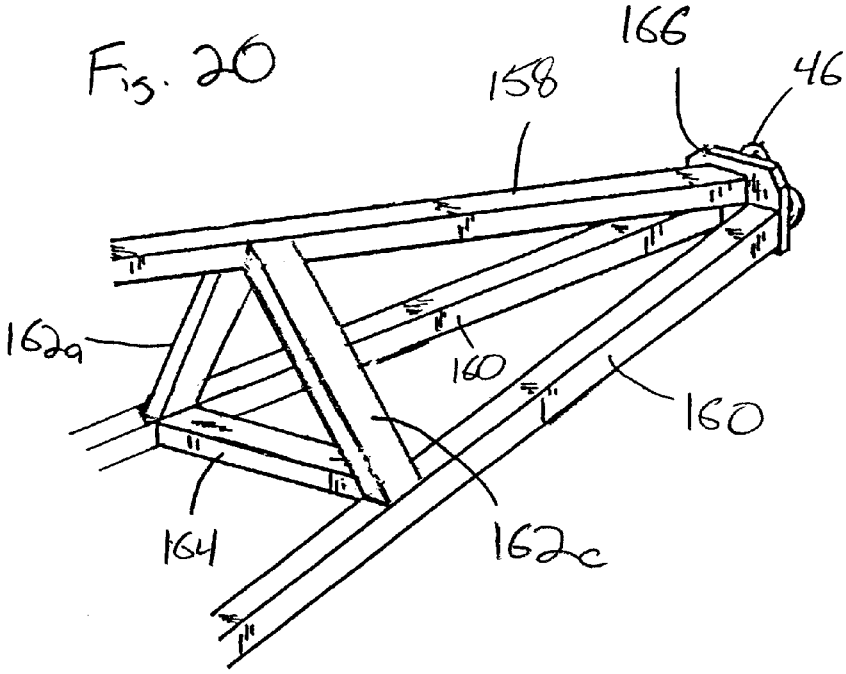
FIG. 20 shows a breakaway sectional view of the truss boom frame of FIGS. 17*a–c* to better illustrate the triangular configuration of the truss boom frame.

As shown in FIGS. 16*a*–16*c*, the pivot sleeve 76*b* and plates 72*a*–*d* are releasably alignable and matable with a second pivot sleeve 76*a* and third pivot sleeve 76*c* retained between pairs of stationary member support plates 74*a*–*d* disposed on opposite ends of the support member 142, as disclosed in the previous embodiment. The pairs of plates 74*a*–*b* and 74*c*–*d* are formed similarly to the truss boom frame support plates 72*a*–*d* and are also connected by a pair of braces 178 extending generally perpendicularly between each of the pairs of plates 74*a*–*b* and 74*c*–*d*, and optionally a secondary brace 178*a*, as best shown in FIGS. 19*a*–19*c*. When the first pivot sleeve 76*b* is aligned between the second pivot sleeve 76*a* and third pivot sleeve 76*c*, the pivot channel 148 is completed and the pivot pin 78 can be inserted through the channel 148 to pivotally secure the truss boom frame 144 to the stationary support member 142.

In order to pivot the boom frame 144 with respect to the support member 142, an actuator 80 is connected between the stationary support member 142 and the boom frame 144 as shown in the previous embodiments. However, in this embodiment, the actuator lever 180 used to connect the actuator 80 to the first pivot sleeve 76*a* has a configuration shown in FIGS. 18*c*–18*d*. The lever 180 includes a pivot sleeve portion 182 which is fixedly attached around the first pivot sleeve 76*b*, and an actuator portion 184 releasably connected to the actuator 80. The pivot sleeve portion 182 and actuator portion 184 are integrally connected to opposite ends of an connecting portion 186. The actuator portion 184 extends outwardly from the connecting portion 186 at an angle of approximately 90° with respect to the longitudinal axis of the connecting portion 186 to increase the pivoting radius of the boom frame 144 with respect to the support member 142.

The elements that comprise the various parts of the articulating truss boom assembly can be formed of any suitable material capable of handling the loads supported by the assembly, e.g., steel or aluminum. The disclosed materials allow for a relatively light boom that can lift as much as 4000 pounds with a 100% safety factor in a dirty and dusty construction environment. For example, in the preferred embodiment the boom is constructed of steel. However, tempered aluminum is generally as strong, but is also lighter. However, an all aluminum structure would be considerably more costly.

Further, the form of the materials forming the parts of the truss boom assembly can also vary. The individual components need not be formed in the disclosed shapes, or assembled in the disclosed configuration, but could be provided in virtually any shape, and assembled in virtually any configuration, so as to provide the desired horizontal pivoting movement. Furthermore, all the disclosed features of each disclosed embodiment can be combined with, or substituted for, the disclosed features of every other disclosed embodiment except where such features are mutually exclusive. For example, the parts can be formed from I-beam sections or lengths of metal tubing formed of the desired structural material. In the preferred embodiment, the various elements of the invention are constructed of the following parts:

| MATERIAL (Ref. No.) | DESCRIPTION | NUMBER REQUIRED |
|---|---|---|
| | BOOM WELDMENT | |
| Rect. Tube (160) | 3 × 1.5 × 3/16 × 133.1 Long | 2 |
| Rect. Tube (162 a and c) | 3 × 1.5 × 3/16 × 14.1 Long | 2 |
| Rect. Tube (162 b and d) | 3 × 1.5 × 3/16 × 24.5 Long | 2 |
| 3/8 Steel (161) | Gusset Plate | 1 |
| Rect. Tube (158) | 3 × 1.5 × 3/16 × 138 Long | 1 |
| Rect. Tube (152) | 3 × 3 × 3/16 × 14 Long | 2 |
| Rect. Tube (153) | 3 × 3 × 3/16 × 28 Long | 1 |
| Rect. Tube (156) | 3 × 3 × 3/16 × 29.3 Long | 2 |
| 3/8 Steel (170) | Mounting Plate | 1 |
| Rect. Tube (164) | 3 × 1.5 × 3/16 × 19.8 Long | 1 |
| Rect. Tube (164) | 3 × 1.5 × 3/16 × 12 Long | 1 |
| 3/4 Steel (166) | Front Plate | 1 |
| McMaster (46) | Weld on Safety Hook | 1 |
| | SMALL HINGE SECTION | |
| Steel Tube (76a) | 2.5 × 9/16 Wall × 5.5 Long | 1 |
| Steel (142) | 34.0 × 5.5 × 3/8 Plate | 1 |
| Steel (74a) | 16.0 × 7.0 × 1/2 Gusset | 2 |
| McMaster | Straight grease fitting | 1 |
| Steel (178) | 5.0 × 3.0 × 1/2 Plate | 2 |
| | ACTUATOR ASSEMBLY | |
| Steel (180) | Actuator arm | 1 |
| Steel Tube (76b) | 2.5 × 9/16 Wall 23.0 Long | 1 |
| Steel (170) | 28.4 × 15.6 × 3/8 Plate | 1 |
| Steel (72a–d) | 16.0 × 7.0 × 1/2 Gusset | 4 |
| McMaster | Straight grease fitting | 3 |
| Steel (179) | 5.0 × 3.0 × 1/2 Plate | 4 |
| | REAR FRAME ASSEMBLY | |
| Steel Tube (82) | Cylinder attachment | 1 |
| Steel Tube (142) | 3 × 3 × 3/16 × 36 Long | 1 |
| Steel Tube (142) | 4 × 3 × 3/16 × 36 Long | 1 |
| Steel Tube (142) | 4 × 2 × 3/16 × 29 Long | 2 |
| Steel Tube (145) | 2 × 2 × 3/16 × 6 Long | 4 |
| Steel Tube (142) | 4 × 2 × 3/16 × 36 Long | 1 |
| Cust. Cylinder (80) | Positioning Cylinder | 1 |
| Steel Tube (142) | 3 × 2 × 3/16 × 36 Long | 1 |

While the present invention has been described in terms of the preferred embodiment, it is recognized that equivalents, alternatives, and modifications, aside from those expressly stated, are possible and within the scope of the appending claims.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

For example, it is contemplated that the hook portion and the securing member may reside on the attachment coupler 14 of the lifting machine, with the mating portion of the attachment coupler similarly residing on the stationary support member. The swapping of connectors permits the same connection to be made between the stationary support member and the lifting machine but with switched connection mechanisms.

As indicated, the machine is preferably specially adapted to operate on new, virtually unimproved construction worksite. As mentioned, the lifting machine is preferably supplied with a leveling mechanism (manual or automatic) to provide stability on rough terrain. This increases the stability and ultimately the lift capacity of the articulating truss boom. The machine also may be fitted with a cleaning mechanism (such as a water jet or air compressor) to ensure dust and dirt does not degrade the performance of the boom or the hydraulics. Another preferred feature is a steel hydraulic insert which better survives the wear and tear in dirty, heavy-lift construction environment than other materials such as brass. Further, all operable joints are sufficiently lubricated to prevent avoidable friction do to dirt built up or wear. The hydraulic system can be easily adapted to fit nearly any hydraulic system (e.g., a open centered or closed centered) through the use of appropriate counter balance valves, such as vented or non-vented varieties. While a four (4) inch hydraulic cylinder is preferred, one can appreciate larger or smaller cylinders depending on the desired displacement of hydraulic pressure. Nevertheless, larger cylinders generally wear better under higher pressures and in more austere environments.

It is intended that the appended claims cover all such additions, modifications and rearrangements. Expedient embodiments of the present invention are differentiated by the appended subclaims.

What is claimed is:

1. A device for setting building sections comprising:

1) an all-terrain lift having
   a) a self-leveling front and rear, and
   b) a dust-sealed cab;

2) a diagonally telescoping boom attached to the lift; and 3) a truss boom assembly removably connected to the boom including:
   a) an articulating truss boom frame;
   b) a support member attachable to the all-terrain lift telescopic boom;
   c) an internal pivot assembly having a vertical pivot axis interposed between the support member and the articulating truss boom frame such that the articulating truss boom frame is capable of pivoting with respect to the support member about the vertical pivot axis in a horizontal plane transverse to the vertical pivot axis; and
   d) a coupling assembly for coupling to the all-terrain lift, the coupling assembly having:
      i) a support beam; and
      ii) a pair of securing members extending from the support member, the securing members having i) a hook portion with a contoured catch having an expanding diameter for ease of attachment to the all-terrain lift, and ii) a securing lobe having an aperture therein for receiving a securing pin in locking engagement with the all-terrain lift.

2. The device of claim 1, wherein the articulating truss boom frame includes:

a) a back portion;

b) a center beam which extends downwardly from the back portion;

c) two base beams extending from the back portion and converging toward the center beam;

d) a front plate connecting the center beam and the base beams to form a triangular structure; and e) a support plate attached to the back portion.

3. The device of claim 1, wherein the articulating truss boom frame includes:

a) a T-support section for bracing and providing additional strength; and b) a load carrying member attached to a front of the boom frame.

4. The device of claim 1, wherein the articulating truss boom frame includes at least two shock absorbing pads attached to at least one of the articulating truss boom frame and support member to prevent contact between the support member and the articulating truss boom frame and to control vibration.

5. The device of claim 1, wherein the articulating truss boom frame includes:

a) first pair and second pair of parallel frame support plates extending outwardly from the truss boom frame;

b) a first frame reinforcement plate transversely connected between the first pair of parallel frame support plates; and c) a second frame reinforcement plate transversely connected between the second pair of parallel frame support plates, wherein each of the frame support plates have an aperture therein.

6. The device of claim 1, a pivot sleeve attached to the articulating truss boom frame and an actuator lever rigidly secured to the pivot sleeve such that movement of the actuator lever results in rotation of the pivot sleeve and therefore rotation of the articulating truss boom.

7. The device of claim 1, wherein the internal pivot assembly includes a hydraulic assembly for horizontally rotating the articulating truss boom frame in an arc having at least a 10.5 foot diameter.

8. The device of claim 7, wherein the hydraulic assembly comprises:

a) an actuator including:
   i) a hydraulic power cylinder securely mounted at a first end to the support member and having a hydraulic fluid connector extending therefrom;
   ii) a moveable plunger arm inserted within a second end of the hydraulic power cylinder to permit translational movement of the moveable plunger arm; and
   iii) an actuator lever attached to the moveable plunger arm and having an aperture to receive the pivot pin therethrough, the actuator lever rotating with respect to the pivot pin and moving the articulating truss boom frame when the moveable plunger arm is in translational movement;

b) a hydraulic control unit connected to the support member for supplying hydraulic fluid to the hydraulic power cylinder;

c) a metering valve connected to the fluid connector and operatively associated with the hydraulic power cylinder, to conduct hydraulic fluid from the hydraulic control unit to the hydraulic power cylinder; and d) a restrictor removably inserted within the metering valve and having a channel therethrough to limit the hydraulic fluid channeled to the hydraulic power cylinder.

9. The device of claim 8 wherein the metering valve comprises an outer wall hexagonal in shape to receive a standard wrench and further comprising a compressor for cleaning the device.

10. The device of claim 1 wherein the articulating truss boom frame includes:

a) a back portion;

b) a center beam which extends upwardly from the back portion;

c) two base beams extending from the back portion and converging toward the center beam;

d) a front plate attached to the center beam and the base beams; and e) a support plate connected to the back portion.

11. The device of claim 1, further comprising a hydraulic assembly for horizontally swinging truss boom comprising:

a) an actuator for moving the boom including:

i) a hydraulic power cylinder mounted at a first end to a support member and having a hydraulic fluid connector extending therefrom;

ii) a moveable plunger arm inserted within a second end of the hydraulic power cylinder to permit translational movement of the moveable plunger arm; and iii) an actuator lever connectably attached to the moveable plunger arm and having an aperture to receive a pivot pin therethrough, the actuator lever rotating with respect to the pivot pin and moving an articulating truss boom frame when the moveable plunger arm is in translational movement;

b) a hydraulic control unit connected to the support member for supplying hydraulic fluid to the hydraulic power cylinder;

c) a metering valve connected to the fluid connector and operatively associated with the hydraulic power cylinder, to conduct hydraulic fluid from the hydraulic control unit to the hydraulic power cylinder; and d) a restrictor removably inserted within the metering valve and having a varying diameter channel therethrough to limit a volume of hydraulic fluid channeled to the hydraulic power cylinder.

12. The device of claim 11, wherein the metering valve includes an outside wall hexagonal in shape.

13. An articulating truss boom assembly for use with an all-terrain lift having a telescopic boom comprising;

1) a triangular articulating truss boom frame;

2) a support member attachable to the telescopic boom; and 3) an internal pivot assembly interposed connecting the support member and the articulating truss boom frame;

wherein the internal pivot assembly further includes:

a) a first pair and a second pair of parallel support member support plates connected to the support member;

b) a first pair and a second pair of parallel truss boom frame support plates connected to the articulating truss boom frame;

c) a first pivot sleeve connected to the truss boom frame support plates;

d) a second pivot sleeve connected to the first pair of support member support plates;

e) a third pivot sleeve connected to the second pair of support member support plates;

f) a single pivot pin insertable into the second and third sleeves and the articulating truss boom frame first sleeve;

g) a plurality of shock absorbing pads attached to at least one of 1) the support member and 2) the articulating truss boom frame to prevent vibration of the articulating truss boom frame; and h) a hydraulic assembly connected to the pivot pin for horizontally rotating the articulating truss boom frame in an arc having at least a 10.5 foot diameter.

14. The articulating truss boom assembly of claim 13, wherein the hydraulic assembly comprises:

a) an actuator including:

i) a hydraulic power cylinder connected at a first end to the support member and having a hydraulic fluid connector extending therefrom;

ii) a plunger arm projecting from a second end of the hydraulic power cylinder; and iii) an actuator lever attached to the plunger arm by a pivot pin plunger arm;

b) a hydraulic control unit connected to the support member for supplying hydraulic fluid to the hydraulic power cylinder;

c) a metering valve connected to the fluid connector and operatively associated with the hydraulic power cylinder, to conduct hydraulic fluid from the hydraulic control unit to the hydraulic power cylinder; and d) a restrictor removably inserted within the metering valve and having a restricting channel therein to limit the hydraulic fluid channeled to the hydraulic power cylinder.

15. A rotating arm for use with a lifting machine comprising:

a) a telescopic boom;

b) an articulating truss boom frame operably associated with the boom;

c) a support member attachable to the telescopic boom; and d) a pivot sleeve attached to the articulating truss boom frame and an actuator lever rigidly secured to the pivot sleeve such that movement of the actuator lever results in rotation of the pivot sleeve and therefore rotation of the articulating truss boom frame; and e) an internal pivot assembly having 1) a vertical pivot axis between the support member and the articulating truss boom frame such that the articulating truss boom frame is capable of pivoting with respect to the support member about the vertical pivot axis in a horizontal plane, 2) a first pair and a second pair of parallel support member support plates connected to the support member, wherein each pair of parallel support member support plates have an opening therein and, 3) a member reinforcing plate perpendicularly connected between each of the pairs of support plates.

16. The arm of claim 15 wherein the articulating truss boom frame includes:

a) a back portion;

b) a center beam which extends downwardly from the back portion;

c) two base beams extending from the back portion and converging toward the center beam;

d) a front plate connecting the center beam and the base beams to form triangular structure.

17. The arm of claim 16 wherein the articulating truss boom frame includes:

a) a first pair of triangular parallel frame support plates having at least one frame reinforcement plate transversely connected between the first pair of parallel frame support plates;

b) a second pair of triangular parallel frame support plates having at least one frame reinforcement plate transversely connected between the second pair of parallel frame support plates, each pair of parallel frame support plates extending outwardly from the truss boom frame; and c) each pair of the support plates having an aperture therein.

18. The arm of claim 17, wherein the internal pivot assembly includes a hydraulic assembly connected to the pivot pin comprising:

a) an actuator including:

i) a hydraulic power cylinder connected at a first end to a support member;

ii) a moveable plunger arm extending from a second end of the hydraulic power cylinder; and iii) an actuator lever attached to the moveable plunger arm and having an aperture to receive a pivot pin therethrough, the actuator lever rotating to move the articulating truss boom frame horizontally with the moveable plunger arm;

b) a hydraulic control unit connected to the support member;

c) a metering valve operatively associated with the hydraulic power cylinder to conduct hydraulic fluid from the hydraulic control unit to the hydraulic power cylinder; and d) a restrictor removably inserted within the metering valve to limit a volume of hydraulic fluid channeled to the hydraulic power cylinder.

19. A telescopic handler having a front and a rear comprising:

1) an enclosed cab;

2) a telescoping boom connected to the rear of the handler and extending diagonally over the cab toward the front of the handler; and 3) an articulating truss boom assembly for attachment to the boom comprising:

a) a support member including:

i) a coupling assembly for coupling the support member to the handler, ii) a first pair and a second pair of parallel support member support plates extending from the support member;

b) an articulating truss boom frame having at a first end a retention member and having at a second end i) a first pair of parallel frame support plates which have a frame reinforcement plate transversely connected therebetween, and ii) a second pair of parallel frame support plates which have a frame reinforcement plate transversely connected therebetween;

c) pivot pin having a vertical pivot axis interposed between the support member and the articulating truss boom frame; and d) a hydraulic assembly connected to the pivot pin for horizontally moving the boom frame comprising:

i) an actuator including:

a hydraulic power cylinder securely mounted at a first end to the support member and having a hydraulic fluid connector extending therefrom;

a moveable plunger arm inserted within a second end of the hydraulic power cylinder to permit movement; and an acutuator lever connectably attached to the moveable plunger arm and having an aperture to receive the pivot pin therethrough, the actuator lever rotating with respect to the pivot pin and moving the articulating truss boom frame when the moveable plunger arm is in translational movement;

ii) a hydraulic control unit connected to the support member for supplying hydraulic fluid to the hydraulic power cylinder;

iii) a metering valve connected to the fluid connector and operatively associated with the hydraulic power cylinder, the metering valve for conducting hydraulic fluid from the hydraulic control unit to the hydraulic power cylinder; and iv) a restrictor removably inserted within the metering valve and having a first and second channel to limit the hydraulic fluid channeled to the hydraulic power cylinder;

wherein the first pair and the second pair of support member support plates and the first pair and second pair of truss boom frame support plates are interlaced so that the apertures of the support members support plates line up with apertures of the truss boom frame support plates to permit the pivot pin to extend therethrough.

20. The articulating truss boom assembly of claim 19 wherein the articulating truss boom frame includes:

a) a back portion;

b) a center beam which extends downwardly from the back portion;

c) two base beams extending in a plane perpendicularly to the back portion and converging toward the center beam;

d) a front plate connecting the center beam and the base beams to form triangular structure; and e) a support plate attached to the back portion.

21. An articulating truss boom assembly comprising:

a) a stationary support member having a first side including a quick release securing means adapted to secure the stationary support member to a lifting machine, and a second side opposite the first side including at least one stationary support assembly connected to the second side, the at least one stationary support assembly having a pair of generally parallel stationary support plates, a pair of first braces spaced from one another and interconnecting the pair of stationary support plates and a first pivot sleeve extending through the pair of stationary support plates;

b) a truss boom frame having a support end and a load carrying end opposite the support end, the support end including at least one pivot support assembly connected to the support, the at least one pivot support assembly having a pair of generally parallel pivot support plates, a pair of second braces interconnecting the pair of pivot support plates and a second pivot sleeve extending through the pair of pivot support plates and alignable with the first pivot sleeve;

c) a pivot pin releasably insertable through the first pivot sleeve and the second pivot sleeve to pivotally secure the boom frame to the support member; and d) a hydraulic actuator connected between the support member and the second pivot sleeve, the actuator operable to horizontally pivot the boom frame with respect to the stationary support member.

22. The assembly of claim 21 wherein the stationary support member includes a pair of stationary support assemblies spaced from one another.

23. The assembly of claim 22 wherein the boom frame includes a pair of pivot support assemblies disposed at opposite ends of the second pivot sleeve.

24. The assembly of claim 23 wherein the pair of pivot support assemblies are insertable between the pair of stationary support assemblies.

25. The assembly of claim 22 wherein the support end of the boom frame includes a pivot support panel attached between the support end and the at least one pivot support assembly.

26. The assembly of claim 22 wherein the hydraulic actuator is connected to the second pivot sleeve by an actuator lever.

27. The assembly of claim 26 wherein the actuator lever includes a pivot sleeve attachment portion and a cylinder attachment portion joined to opposite ends of an arm.

28. The assembly of claim 27 wherein the cylinder attachment portion has a longitudinal axis oriented 90° from a longitudinal axis of the arm.

29. The assembly of claim 21 wherein the pivot support panel has a narrow end spaced opposite a wide end.

30. The assembly of claim 26 wherein the narrow end forms a top end of the pivot support panel.

31. The assembly of claim 21 wherein the stationary support member includes a number of reinforcing members attached to the support member opposite the truss boom frame.

32. The assembly of claim 31 wherein the reinforcing members include a sloped surface at one end.

33. An articulating truss boom assembly comprising:

a) a stationary support member having a first side and a second side opposite the first side, the first side including a quick release securing means adapted to secure the stationary support member to a lifting machine, the second side including at least one stationary support assembly having a pair of generally parallel stationary support plates, a pair of first braces spaced from one another and interconnecting the pair of stationary support plates and a first pivot sleeve extending through the pair of stationary support plates between the first braces;

b) a truss boom frame having a support end and a load carrying end opposite the support end, the support end including at least one pivot support assembly, the at least one pivot support assembly having a pair of generally parallel pivot support plates, a pair of second braces interconnecting the pair of pivot support plates and a second pivot sleeve extending through the pair of pivot support plates between the second braces and alignable with the first pivot sleeve, the frame including a pair of angled lower frame members connected at one end to opposite sides of the support end and to one another adjacent the load carrying end, an upper frame member connected at one end to the support end opposite the lower frame members and to the lower frame members adjacent the load carrying end, and a plurality of opposed pairs of side frame members extending between the lower frame members and the top frame member;

c) a pivot pin releasably insertable through the first pivot sleeve and the second pivot sleeve to pivotally secure the boom frame to the support member; and d) a hydraulic actuator connected between the support member and the second pivot sleeve, the actuator used to pivot the boom frame with respect to the support member.

34. The assembly of claim 33 wherein the frame further includes a plurality of struts extending between the lower frame members adjacent each pair of side frame members.

35. The assembly of claim 33 wherein the support end is formed of a bottom beam, a top beam and a pair of side beams extending between the top and bottom beams.

36. The assembly of claim 35 wherein the top beam is shorter than the bottom beam.

37. The assembly of claim 36 wherein the opposed pairs of side frame members and the side beams extend inwardly toward the upper frame member.

38. The assembly of claim 35 wherein the lower frames are connected to the bottom beam.

39. The assembly of claim 35, further comprising a triangular top plate on the top back portion of the boom.

* * * * *